US007965026B2

(12) United States Patent
Aurongzeb et al.

(10) Patent No.: US 7,965,026 B2
(45) Date of Patent: Jun. 21, 2011

(54) LAMP WITH IR SUPPRESSING COMPOSITE

(75) Inventors: Deeder Aurongzeb, Mayfield Heights, OH (US); Ronald James Olwert, Concord Township, OH (US)

(73) Assignee: General Electric Company, Schenectady, NY (US)

( * ) Notice: Subject to any disclaimer, the term of this patent is extended or adjusted under 35 U.S.C. 154(b) by 163 days.

(21) Appl. No.: 12/491,408

(22) Filed: Jun. 25, 2009

(65) Prior Publication Data

US 2010/0327731 A1 Dec. 30, 2010

(51) Int. Cl.
*H01J 1/14* (2006.01)

(52) U.S. Cl. ..... 313/345; 313/315

(58) Field of Classification Search ..... 313/483–493, 313/623, 627–643, 567, 111–117, 25–27, 313/318.01–318; 439/615, 739; 445/24, 445/26, 29, 22

See application file for complete search history.

(56) References Cited

U.S. PATENT DOCUMENTS

| | | | | |
|---|---|---|---|---|
| 1,775,187 | A * | 9/1930 | Bondiek | 315/69 |
| 1,854,970 | A | 4/1932 | Agate | |
| 3,443,143 | A * | 5/1969 | Koo | 313/311 |
| 3,992,201 | A * | 11/1976 | Koo et al. | 419/4 |
| 4,283,653 | A * | 8/1981 | Brett | 313/341 |
| 4,296,352 | A * | 10/1981 | Berlec et al. | 313/315 |
| 6,424,089 | B1 * | 7/2002 | Binder et al. | 313/634 |
| 6,597,107 | B1 | 7/2003 | Mészáros et al. | |
| 2002/0100876 | A1 * | 8/2002 | Murakoshi et al. | 250/424 |
| 2008/0024061 | A1 | 1/2008 | Bunk et al. | |
| 2008/0036382 | A1 * | 2/2008 | Wolf et al. | 313/631 |
| 2008/0237500 | A1 | 10/2008 | Zalyubovskiy et al. | |
| 2009/0045742 | A1 | 2/2009 | Bunk et al. | |

FOREIGN PATENT DOCUMENTS

JP 02284345 A * 11/1990

* cited by examiner

*Primary Examiner* — Nimeshkumar D Patel
*Assistant Examiner* — Donald L Raleigh
(74) *Attorney, Agent, or Firm* — Fay Sharpe LLP

(57) ABSTRACT

A lamp includes a filament for emitting light. The filament includes an emissive substrate which emits radiation when an electric current is applied. The substrate includes a doped surface and a coating layer supported on the doped surface. The coating layer includes at least one of a carbonitride and a boride.

22 Claims, 5 Drawing Sheets

LAMP WITH IR SUPPRESSING COMPOSITE

BACKGROUND OF THE DISCLOSURE

The exemplary embodiment relates to increasing efficiency in an incandescent lamp. It finds particular application with regard to lamps comprising a tungsten or carbon filament, such as a rhenium and carbonitride containing filament, for reducing thermal stress and brittleness while increasing the efficiency of a lamp, and will be described with particular reference thereto.

Tungsten or carbon filaments for incandescent lamps are well known in the art. In most applications, the filaments are made of a wire which is wound into a coil. Coil dimensions determine not only the achievable light output of the lamp, but also the optical projector system of the lamp.

During filament production, the coiled filaments are annealed (heat treated to preserve the shape of the filament). This annealing serves to enable the assembly of the filaments on an automated mounting machine without breaking. During the annealing of the coils, that part of the coils made of tungsten wires tends to re-crystallize, at least partly, and mainly on the compressed side of the coil. This partial re-crystallization significantly increases the probability that the coil will break. This leads to the failure of the lamp in a short time. Since for these lamps, the allowed defect rate is critical for marketability, a high defect rate cannot be tolerated.

Thus, there remains a need for a lamp with improved thermal stress and reduced brittleness while providing desirable illumination and energy efficiency.

BRIEF DESCRIPTION OF THE DISCLOSURE

One aspect of the exemplary embodiment relates to a lamp that includes a filament for emitting light. The filament includes an emissive substrate which emits radiation when an electric current is applied. The substrate further includes a doped surface and a coating layer supported on the doped surface. The coating layer includes at least one of a carbonitride and a boride.

Another aspect of the exemplary embodiment relates to a method of forming a filament that includes doping a surface of an emissive substrate. The method further includes annealing the doped substrate to form a diffusion layer and depositing a coating layer on the doped substrate, the coating layer including at least one metal which reduces carbon diffusion into the substrate.

Another aspect of the exemplary embodiment relates to a lamp that includes an envelope. A filament is sealed within the envelope. The filament comprises first and second layers having different material compositions. The first layer includes a material which emits light when heated. The second layer includes a composite material which includes a metal, boron, carbon, and nitrogen. An electrical conductor is connected with the filament for connecting the filament with a power source.

One advantage of at least one embodiment of the present disclosure is the provision of a lamp with improved performance and luminous efficiency.

Another advantage of at least one embodiment of the present disclosure is the provision of a lamp filament with improved thermal stress and reduced brittleness.

Another advantage of at least one embodiment of the present disclosure is the provision of a filament with improved high temperature stability.

Still further advantages will become apparent to those of ordinary skill in the art upon reading and understanding the following detailed description of the preferred embodiments.

DETAILED DESCRIPTION OF THE PREFERRED EMBODIMENTS

Aspects of the exemplary embodiment relate to a filament for use in lamps capable of high temperature stability. In various embodiments, tungsten filaments of various embodiments, which previously suffered from thermal stress and brittleness, incorporate functional materials which now provide increased lamp efficiency. In the description below, the lamp is described in terms of an incandescent halogen lamp, although it is to be appreciated that other lamp types are also contemplated.

The exemplary lamp finds application in a variety of applications including household lighting, projection lamps, and illumination in stores and other commercial applications.

Figure 1:
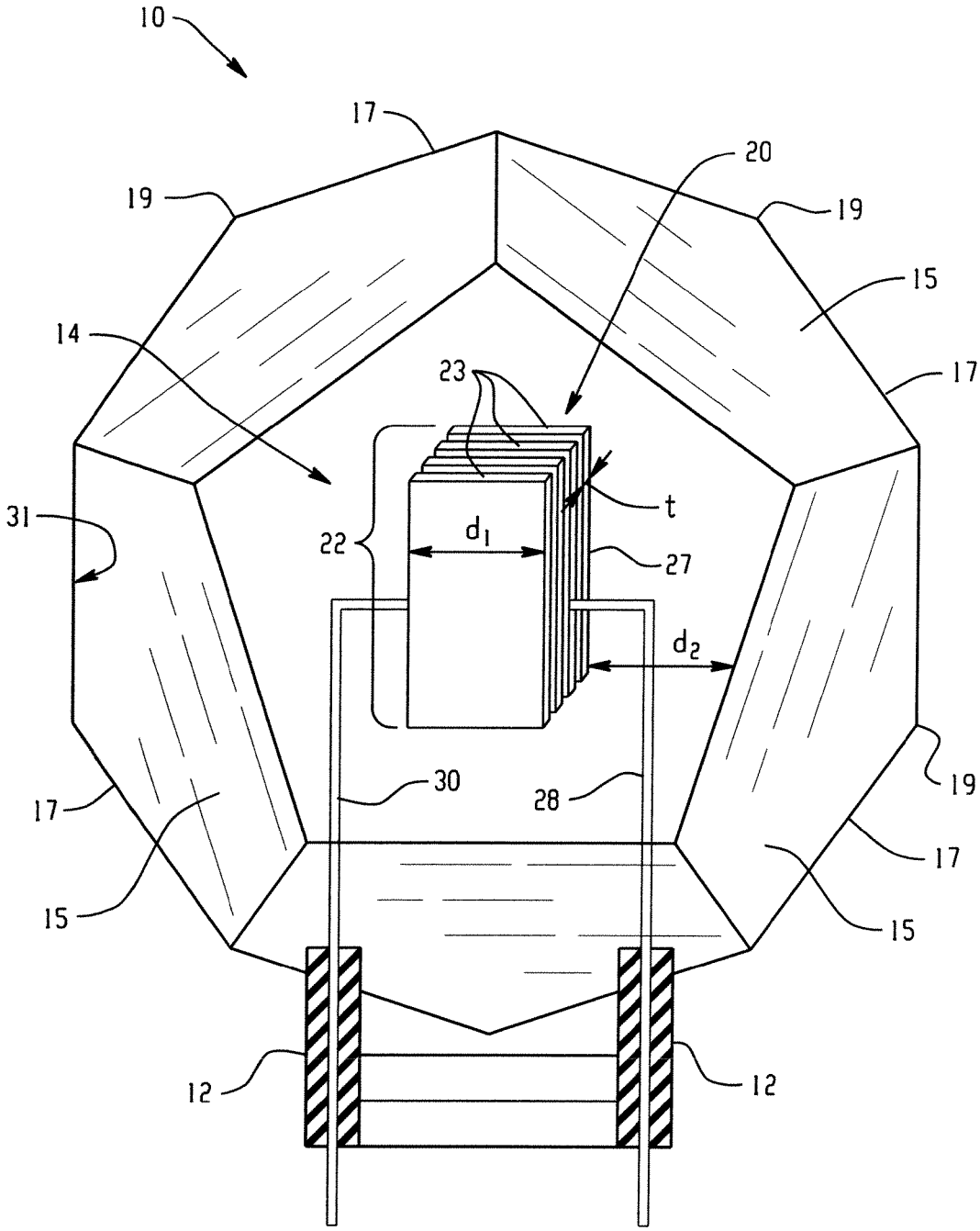
FIG. 1 is a perspective view of an incandescent lamp in accordance with one aspect of the exemplary embodiment.

With reference to FIG. 1, one embodiment of an exemplary halogen incandescent lamp is shown. The lamp includes an envelope 10 which is hermetically sealed, for example, by a seal 12 at one or both ends, to define an interior chamber 14. While FIG. 1 shows a single ended lamp envelope, double ended lamp envelopes are also contemplated. The illustrated envelope 10 is non-circular, i.e. has a three-dimensional shape made of a plurality of geometric planar faces 15. The faces 15 define a plurality of edges 17 intersecting at common points or vertices 19. The geometric faces 15 may have a shape selected from a triangle, tetragon, pentagon, hexagon, heptagon, octagon, nonagon, decagon, hendecagon, dodecagon, tridecagon, tetradecagon, and combinations thereof. The exemplary faces are regular polygons, although, irregular shapes are also contemplated.

In one embodiment, the envelope includes at least three planar faces. In another embodiment, the envelope includes at least four or at least six planar faces. In yet another embodiment, the envelope includes up to sixty planar faces. The illustrated envelope, by way of example, has pentagon shaped faces, of which only six are illustrated for ease of illustration.

It is to be appreciated, however, that the envelope may be elliptical, cylindrical, or other suitable lamp shape.

The envelope 10 is formed of a material which is light transmissive, i.e., transmissive to radiation in the visible range and may also be transmissive in the IR range. Suitable materials for forming the envelope include transparent materials, such as quartz glass, and other vitreous materials, although translucent materials, such as ceramic materials, are also contemplated. In one embodiment, the envelope is formed of aluminosilicate glass or quartz doped with Zr and/or Ta in an amount of at least 0.1% by weight, such as 5% Zr and 2% Ta.

The lamp includes a filament 20. The filament 20 emits radiation in at least the visible range and generally also the IR range of the spectrum when electric current is applied thereto. The illustrated filament 20 includes at least one current conducting member, here illustrated in FIG. 1 as a plate stack 22, which is disposed within the interior chamber 14. The plate stack 22 comprises a plurality of planar plates 23 arranged in layers parallel to each other. The number of plates in the stack 22 may be at least two, and generally less than about 6, e.g., about 4.

Figure 2:
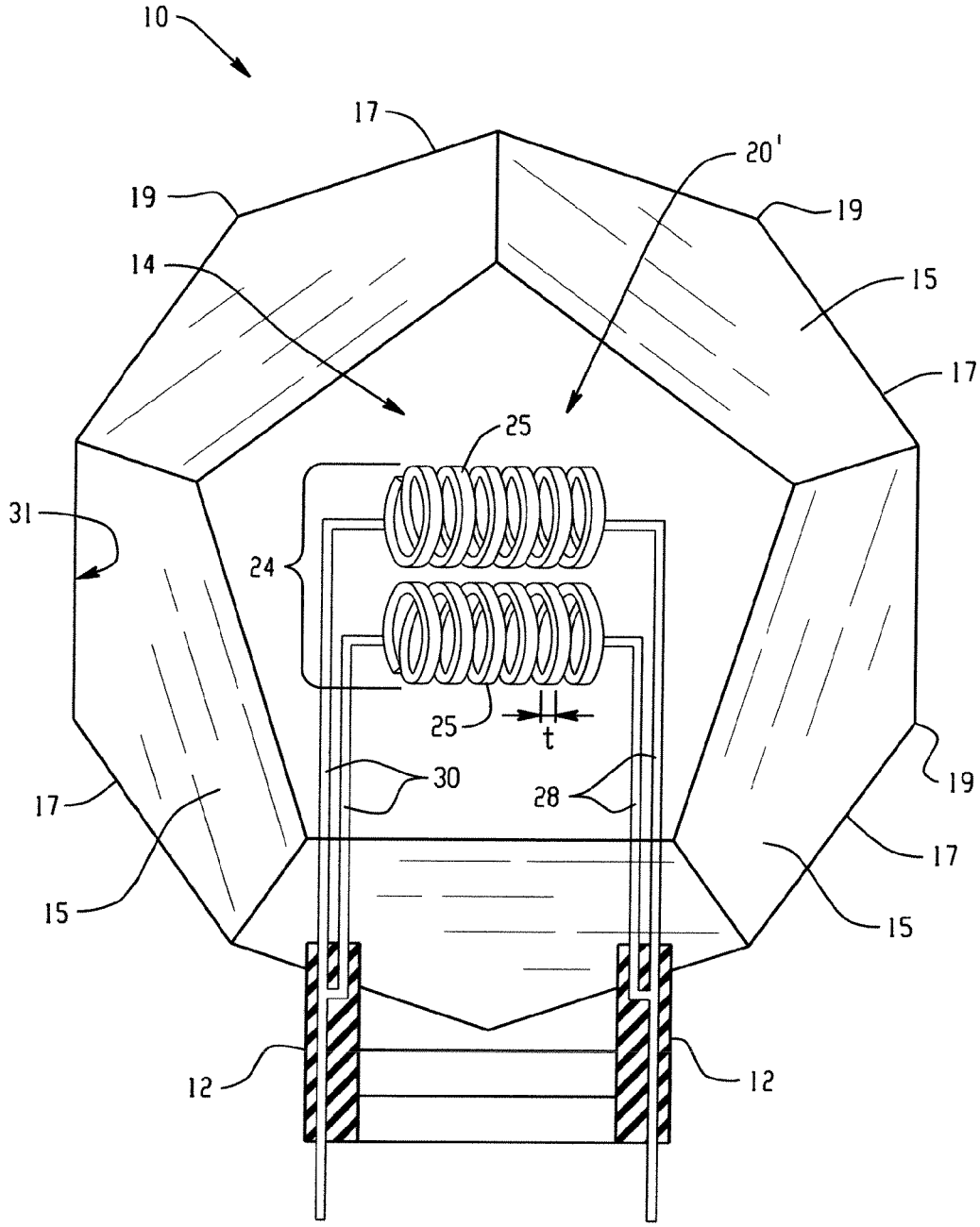
FIG. 2 is a perspective view of an incandescent lamp in accordance with another aspect of the exemplary embodiment.

Rather than a plate stack type of filament 20, other radiation filaments are contemplated. FIG. 2 illustrates a similar lamp to that of FIG. 1 except that the filament 20' includes a coil stack 24. The coil stack 24 comprises a plurality of concentric superposed turns to form planar parallel coils 25. The number of coils 25 in the stack 24 may be at least two, and generally less than about 6, e.g., about 4.

The plates or wiring forming coils may have an approximate thickness t which is less than about 150 μm, e.g., about 5-100 μm, and in one embodiment, at least about 10 μm, such as about 60 μm.

As illustrated in FIG. 1, distance $d_1$ is the width of each planar plate 23. Distance $d_2$ is the distance between an edge 17 of a planar face 15 and an edge 27 of a planar plate 23. The distance $d_2$ is greater than the distance $d_1$.

The filament 20, 20' is connected with an exterior source of electrical power, e.g., via an electronic circuit comprising a ballast (not shown). In the illustrated embodiment, the connection is made via electrically conducting connectors 28, 30 such as wires, passing through the seal 12.

In a conventional lamp, evaporated material of the filament tends to condense on the inner surface 31 of the envelope 10 causing it to darken. Filament evaporation and envelope darkening results in light loss or decrease lamp efficiency. In the present embodiment, the chamber 14 may be filled with a fill gas which helps to reduce evaporation of the filament, such as an inert gas, e.g., a mixture of helium and nitrogen (such as 500 torr helium and 100 torr nitrogen) or a halogen-containing fill. In other embodiments, the fill may include an inert gas, such as nitrogen, helium, and/or argon, and an additive in an amount of at least 1% by weight. The additive may be least one of dimethyl amino tantalum ($Ta(N(CH_3)_2)_5$ and BX, where X represents a halogen selected from F, Cl, I, and combinations thereof. As an example, the fill may comprise nitrogen (e.g., at 40-95 wt %, e.g., about 90 wt %) argon (e.g., at 2-20 wt %, e.g., about 5 wt %), at least 2% dimethyl amino tantalum (e.g., about 4%), and optionally at least 1 wt % BX (e.g., about 2%). One example fill may include 50 wt % nitrogen, 40 wt % helium, 5 wt % dimethyl amino tantalum and 5% BX.

In one aspect of the exemplary embodiment, the non-circular envelope 10 having a plurality of edges 17 intersecting at common points or vertices 19 creates, within the lamp's envelope, uneven convection. In another aspect of the embodiment, the plate stack filament 20 or coil stack filament 20' design induces circular convection around the filament. This embodiment in combination reduces evaporation and condensation around the filament 20, 20' thereby increasing lamp efficiency.

The emission quality of a lamp may be characterized by parameters such as color temperature and color rendition index (CRI). The correlated color temperature CCT of a lamp is determined by comparing the color of the source with a theoretical, heated black-body radiator. In some embodiments, the color temperature of the lamp may be, for example, greater than 2,200 Kelvin (K). In some further embodiments, the color temperature of the lamp is greater than 2,500 K, and in one embodiment, less than about 3,800 K.

CRI is a measure of the ability of a light source to reproduce the colors of various objects being lit by the source. In various embodiments including the compositions described herein, the color rendition index (CRI) of the lamp is typically in a range from about 70 to about 95. In some embodiments, the CRI may be at least about 80, and generally less than about 98, e.g., about 95.

Figure 3:
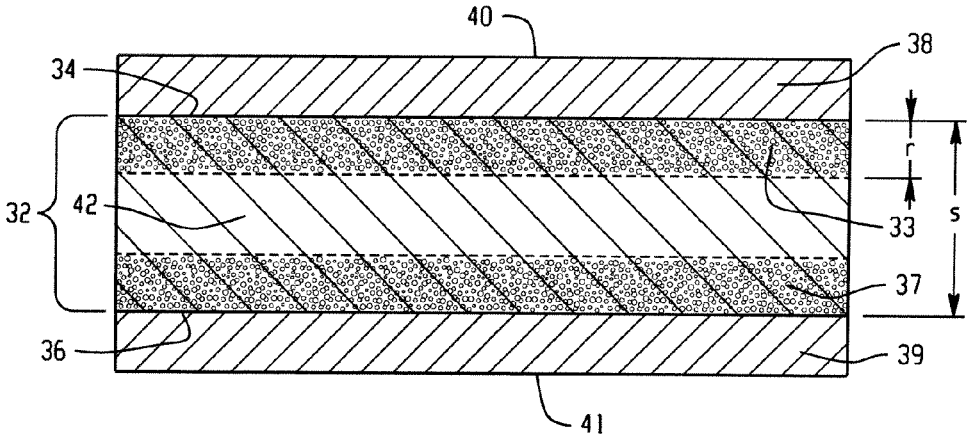
FIG. 3 is a enlarged cross-sectional view of a portion of the filament of FIGS. 1 and 2 with doped substrate and coating layer for the lamp of FIG. 1 in accordance with one aspect of the exemplary embodiment.

As shown in FIG. 3, the filament 20, 20' of FIGS. 1 and 2 includes a substrate 32. A diffusion layer 33 defines an exterior portion of the substrate 32. The diffusion layer helps to reduce the effect of thermal stress and brittleness. The substrate 32 is planar having opposing planar first and second surfaces 34, 36. The diffusion layer 33 is annealed within an exterior portion of the planar first surface 34 of the substrate 32. In one embodiment, a diffusion layer 37 analogous to layer 33 is annealed within an exterior portion of the planar second surface 36. As shown in FIG. 3, the filament plate includes a coating layer 38 which is supported on the substrate 32. In the exemplary embodiment, layer 38 defines the outermost surfaces 40, 41 of the filament plate/coil, although it is also contemplated that additional layers may be provided. Additionally, while layer 38 is contiguous with interface 34, it is also contemplated that layer 38 may be spaced from interface 34 (and analogously for layer 39). In one embodiment, opposed surfaces 34, 36 of the substrate 32 may each support a coating layer 38, 39. The combination of a diffusion layer(s) 33 and coating layer(s) 38 modifies the substrate 32 to produce a filament 20, 20' with an operating temperature of at least 2700 K along with a higher melting point and lower vapor pressure. With this combination, it is also possible to suppress the emission and/or suppress the transmission of infrared radiation from the substrate 32 at a normal operating temperature of the lamp filament (e.g., from 2700 K-3300 K) to improve overall efficiency of the lamp.

The exemplary substrate 32 is predominantly tungsten, i.e. >50% tungsten, and in once embodiment at least >80% tungsten. The diffusion layer 33 within a portion of the substrate 32 includes a dopant which is at least one of tantalum, rhenium, osmium, platinum, and which is dispersed in the tungsten. In one aspect of the exemplary embodiment, the diffusion layer 33 of substrate 32 is tungsten doped with rhenium.

The substrate 32 may have a thickness s of at least 20μ, and generally less than about 200μ, e.g. 50μ. The diffusion layer 33 may have a thickness r of at least about 6μ, and generally less than about 60μ, e.g., about 15μ. Of course, layer 33 is less than one-half the thickness of layer 32.

As shown in Table 1, rhenium has a higher linear expansion coefficient and a lower hardness, compared to tungsten. This greater difference between rhenium and tungsten allows for adaptability to thermal expansion and reduced hardness or brittleness respectively of the filament. In order to minimize the change in tungsten properties while maximizing the effects of the thin film diffusion layer, the rhenium may be at least about 10% of the diffusion layer at the surface 34, 36, and generally less than about 50% at the surface, e.g., about 30% at the surface. The dopant concentration diminishes away from the surface 34, such that a core 42 of the filament is predominantly tungsten, e.g., >95% tungsten, or >99% tungsten.

TABLE 1

| | Linear Expansion Coefficient (10−6 m/m K) | Vicker's Hardness (HV) |
|---|---|---|
| Tantalum (Ta) | 6.3 | 873 |
| Tungsten (W) | 4.5 | 3430 |
| Rhenium (Re) | 6.2 | 2450 |
| Osmium (Os) | 5.1 | >2700 |
| Platinum (Pt) | 8.8 | 543 |

Linear Expansion Coefficient relates the change in temperature to the change in a material's linear dimensions. The Vicker's Hardness test is based on observing a material's ability to resist plastic deformation from a standard source. The unit of hardness given by the test is known as the Vickers Pyramid Number (HV).

In one embodiment, there is a difference in melting point between the substrate and the coating layer 38, with that of the substrate 32 being higher than that of the coating layer 38 (for example, when the substrate is tungsten doped with rhenium). This reduces the possibility of interface diffusion occurring. Interface diffusion may compromise the structural integrity of the substrate and thus its performance.

The coating layer 38 may include a metal carbonitride. The carbonitride may be selected from ZrCN, ZrNbCN, NbCN, HfCN, HfNbCN, TaCN, TaNbCN and combinations thereof. In one embodiment, the metal carbonitride includes a tantalum niobium carbonitride, $TaNb_wC_xN_y$, wherein $w \leqq 0.5$, $x \geqq 0.5$, and $y=1-x$.

Another suitable composite which comprises a refractory metal, such as tantalum (Ta), in combination with boron (B), carbon (C), niobium (Nb), and nitrogen (N) such as $TaNb_wB_xC_yN_z$, where $w \leqq 0.5$, $x \geqq 0.5$, $y=1-x$, $z \leqq 1$ may be employed as coating layer 38 as it is adaptable to high temperature stress. In this embodiment, tantalum may be at least 18 wt %, e.g., at least 23 wt %, and may be up to 28 wt %, e.g., up to 25 wt % of layer 38. Niobium may be at least 8 wt %, e.g., at least 10 wt %, and may be up to 12 wt %, e.g., up to 11 wt % of layer 38. Boron may be at least 6 wt %, e.g., at least 7 wt %, and may be up to 9 wt %, e.g., up to 8 wt % of layer 38. Carbon may be at least 32 wt %, e.g., at least 40 wt %, and may be up to 48 wt %, e.g., up to 44 wt % of layer 38. Nitrogen may be at least 16 wt %, e.g., at least 20 wt %, and may be up to 24 wt %, e.g., up to 22 wt % of layer 38.

In one embodiment, the wt % ratio of nitrogen to boride in the fill may be from 4:1 to 1.5:1. In another embodiment, the wt % ratio of nitrogen to boride in the fill may be up to 3:1, e.g., at least 2:1.

The coating layer 38 may additionally or alternatively include a metal and/or metal compound selected from high melting point metals and borides, such as $ZrB_2$, $NbB_2$, $HfB_2$, $TaB_2$, and B and combinations thereof. In one embodiment, the metal boride is niobium diboride. In one embodiment, the coating layer 38 includes a carbonitride layer which is spaced from the rhenium doped tungsten substrate by a boride layer, such as a niobium diboride layer, in which the B wt %>(N+C) wt %.

Elements other than Ta, B, C, Nb, and N may make up less than 10 wt % of layer 38. In one embodiment, layer 38 is predominantly formed (e.g., at least 80% by weight, or at least 90% by weight) of a mixture of tantalum niobium carbonitride and tantalum diboride.

In one embodiment, the coating layer 38 composite may be configured for radiation emission predominantly at wavelengths in a range from about 300 nanometers to about 1500 nanometers. In a further embodiment, the composition may be configured for radiation emission dominantly at wavelengths in a range from about 400 nanometers to about 700 nanometers. In yet a further embodiment, the composition may be configured for radiation emission dominantly at wavelengths in a range from about 700 nanometers to about 1500 nanometers. The coating layer 38 in part influences the emissivity of the surface positively in the visible spectrum range. For example, a nitrogen content greater than 20 wt % may block light in the infrared spectrum region, e.g., greater than 800 nanometers thereby increasing light in the visible regions, e.g., about 600 nanometers.

The coating layer 38 composite of the various embodiments described herein may exhibit tailored reflection spectrum. In one embodiment, the composition may be configured to reflect incident light predominantly at wavelengths in the infrared region of the electromagnetic spectrum. For example, the composition may be configured to predominantly reflect wavelengths greater than about 700 nanometers.

The reflective properties of the coating layer 38 composition may enable its use in systems requiring thermal management. The combination of constituents and form of the compositions may be varied to produce a desired reflection spectrum. In particular, the coating layer 38 compositions may find use in systems where radiation control and thermal balance is desirable. Non-limiting examples of applications include in reflectors, lasers, photovoltaic devices, ovens, and systems where infrared signature is required to be modified or altered.

The coating layer 38 may have a thickness w of at least about 100 nm, and generally less than about 1μ, e.g., about 300 nm.

A method of forming the filament 20, 20' includes depositing rhenium on the substrate 32. Suitable deposition techniques include chemical vapor deposition (CVD), and ion beam deposition. The rhenium doped substrate 32 may then undergo rapid thermal annealing for at least 12 hours and up to about 24 hours at a temperature of at least 1000° C. to up to about 2000° C. or higher, forming a diffusion layer 33 within an exterior portion of the substrate 32. For example, 5 hours at 2500° C. may be sufficient for annealing a layer of rhenium within an exterior portion of the tungsten substrate. Longer times, e.g., >12 hours, may be appropriate. The annealing time may depend on the amount of rhenium deposited on the substrate 32 and the melting point of the forming diffusion layer 33 which may be at least 2800° C. to up to about 3200° C.

In one aspect of the embodiment, the method further includes depositing or otherwise forming a contiguous coating layer 38, 39 on the doped substrate 32. Suitable deposition techniques include chemical vapor deposition (CVD), ion beam deposition, and liquidthermal deposition.

Figure 4:
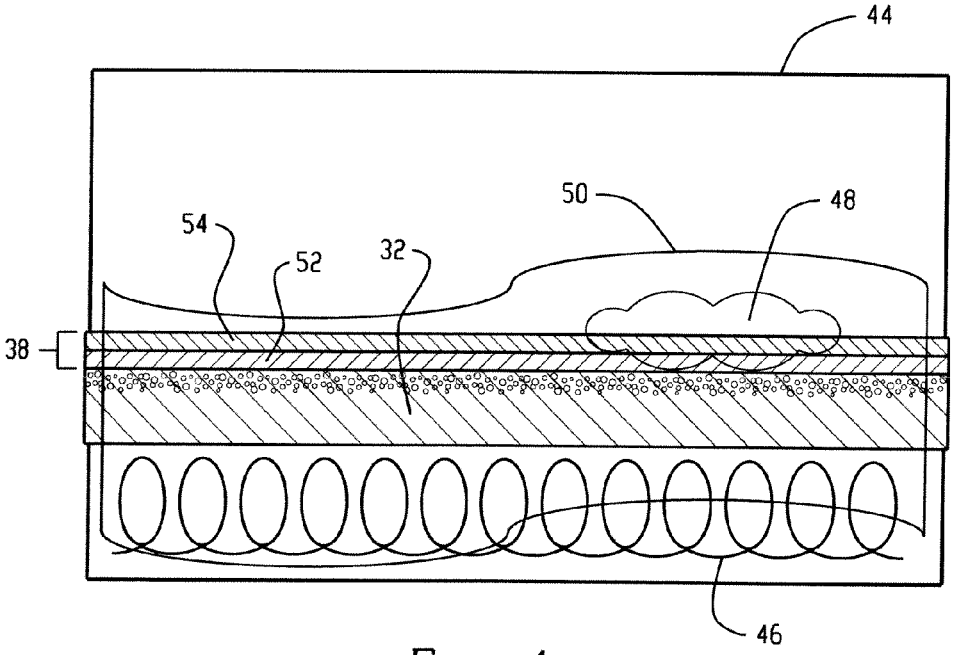
FIG. 4 is an enlarged cross-sectional view of a liquidthermal deposition method for forming high density filament materials.

As illustrated in FIG. 4, niobium diboride can be deposited on the rhenium doped substrate 32 using the method of liquidthermal deposition. In this method, the rhenium doped tungsten substrate 32 is placed in a high pressure chamber 44. The high pressure chamber 44 is pressurized using an inert gas mixture of argon/hydrogen gas. The chamber 44 is further provided with a high current source 46 (e.g., resistance wire connected to an external power source) to supply current to the rhenium doped substrate 32. A composition 48 of 60 wt % $NbCl_5$, 30 wt % BI, and 10 wt % hexamethyldisilazane is then combined in a quartz or ceramic boat 50 placed inside the reaction chamber 44. The composition 48 is heated by the current source 46 to a temperature of about 1000° C. The surrounding temperature of the chamber 44 is kept constant at about 400° C. Once the substrate 32 reaches a temperature of about 900° C., a niobium diboride layer 52 forms on the doped substrate 32. In another embodiment, tantalum diboride is prepared similarly.

The liquidthermal method may further include depositing tantalum niobium carbonitride onto the niobium diboride layer 52. A composition 48 of 50 wt % $TaCl_5$+30 wt % $NbCl_5$+15 wt % $NaN_3$+ and 5 wt % benzene is combined in the quartz or ceramic boat 50 inside the reaction chamber 44. The composition 48 is heated by the current source 46 to a temperature of about 1000° C. The surrounding temperature of the chamber 44 is kept constant at about 400° C. Once the substrate 32 reaches a temperature of about 900° C., a tantalum niobium carbonitride layer 54 forms on the niobium diboride layer 52.

The niobium diboride layer 52 and the tantalum niobium carbonitride layer 54 may then undergo rapid thermal annealing in the presence of the doped substrate 32 for at least 12 hours and up to about 24 hours at a temperature of at least 1000° C. to up to about 2000° C. or higher to form coating layer 38. For example, 5 hours at 2500° C. may be sufficient for annealing a coating layer 38 on the doped substrate 32. Longer times, e.g., >12 hours, may be appropriate for predominantly tungsten substrates. The annealing time may depend on the thickness of the layer 38 and the melting point of the material of coating layer 38 which may be at least 2800° C. to up to about 3800° C. (i.e., higher than the annealing temperature). The annealing temperature is selected to be below the melting point of the material in coating layer 38 but high enough to create a strong bond between the doped substrate 32 and the layer 38 optionally by diffusion of one material into the other.

Figure 5:
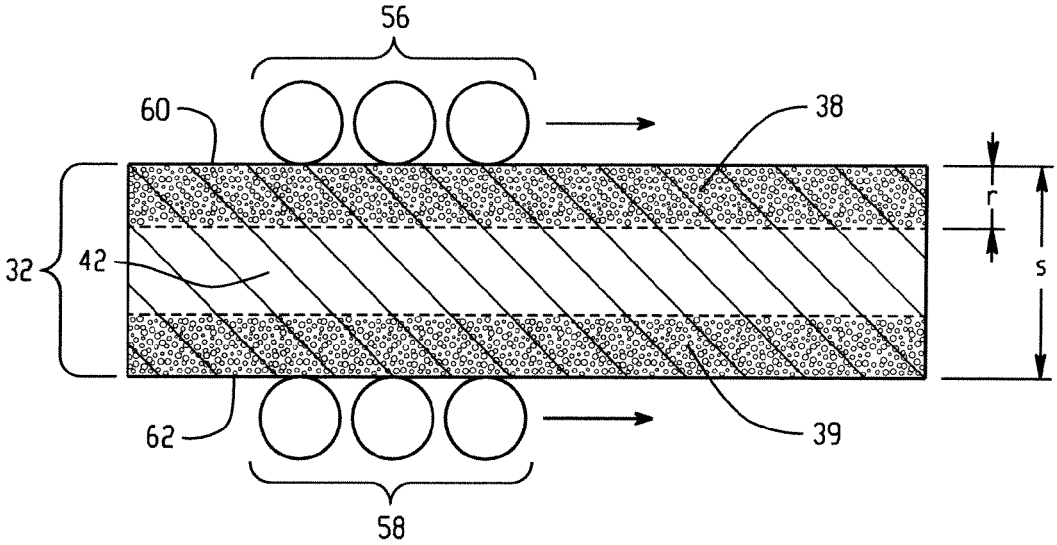
FIG. 5 is an enlarged cross-sectional view of a compressed force method for forming high density filament materials.

Since at temperatures of about 2000° C., dislocations or crystallographic defects are not sufficiently annihilated by the annealing process, the method further includes mechanically deforming the composite annealed coating layer 38 and rhenium doped tungsten substrate 32. As illustrated in FIG. 5, the continuous deformation method includes compressing the layer 38 and substrate 32 between a series of rollers 56 and 58, with one set rolling across the top 60 and one set rolling across the bottom 62. These series of rollers mechanically deform the layer 38 and substrate 32 by hammering or applying pressure with a high frequency and temperature, e.g., greater than 60 Hz and 2000° C. respectively. The series of rollers 56 and 58 rotate in opposite directions passing the composite back and forth several times. The composite is further reduced in thickness by passing it several times through the rollers 56 and 58. The method crystallizes the composite while annihilating the dislocations to form a more homogeneous material in order to increase ductility for elongation and prevent cracking or failure of the formed filament. The compressive force of the hammer rollers 58, and 60 may be at least about 0.5 Pascal (Pa), and generally less than about 2 Pascal (Pa), e.g., about 1 Pascal (Pa). In one embodiment, the continuous deformation method compresses the composite to form a planar plate layer stack 23 for filament 22.

Figure 6:
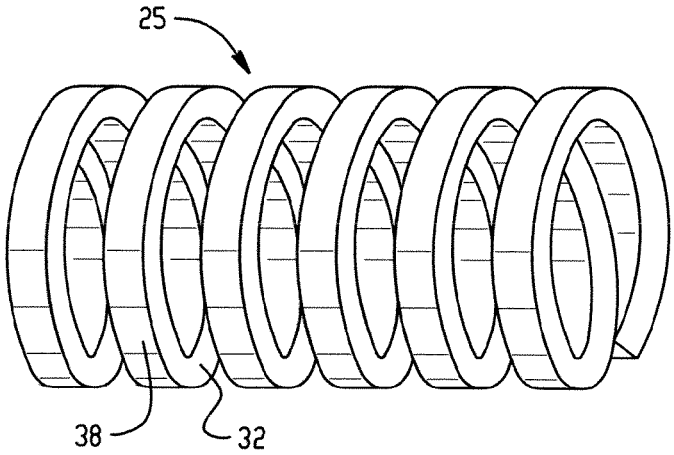
FIG. 6 is an enlarged perspective view of a filament in the form of a coil stack of the lamp of FIG. 2 showing in greatly enlarged cross-sectional view a portion thereof.

In another aspect of the embodiment, as illustrated in FIG. 6, the method further includes spirally winding the compressed composite into a plurality of concentric superposed turns to form a planar coil stack. The outer surface of the coil stack comprises the coating layer 38 and the inner surface comprises the rhenium doped tungsten substrate 32.

To form an incandescent lamp, the filament 20, 20' is inserted into an envelope 10 and the envelope 10 filled with a fill as previously described, and sealed. The filament is connected to conductors 28, 30 which are sealed in the envelope 10. The filament may be of a plate stack or coil stack form.

While the exemplary lamp is described in terms of an incandescent lamp, it is to be appreciated that the exemplary filament may find application in other lamps which emit radiation in the IR range, such as ceramic metal halide lamps, halogen incandescent lamps, and the like.

Without intending to limit the scope of the present invention, the following example demonstrates the formation of lamps with improved lumen maintenance.

EXAMPLE

Example 1

Figure 7:
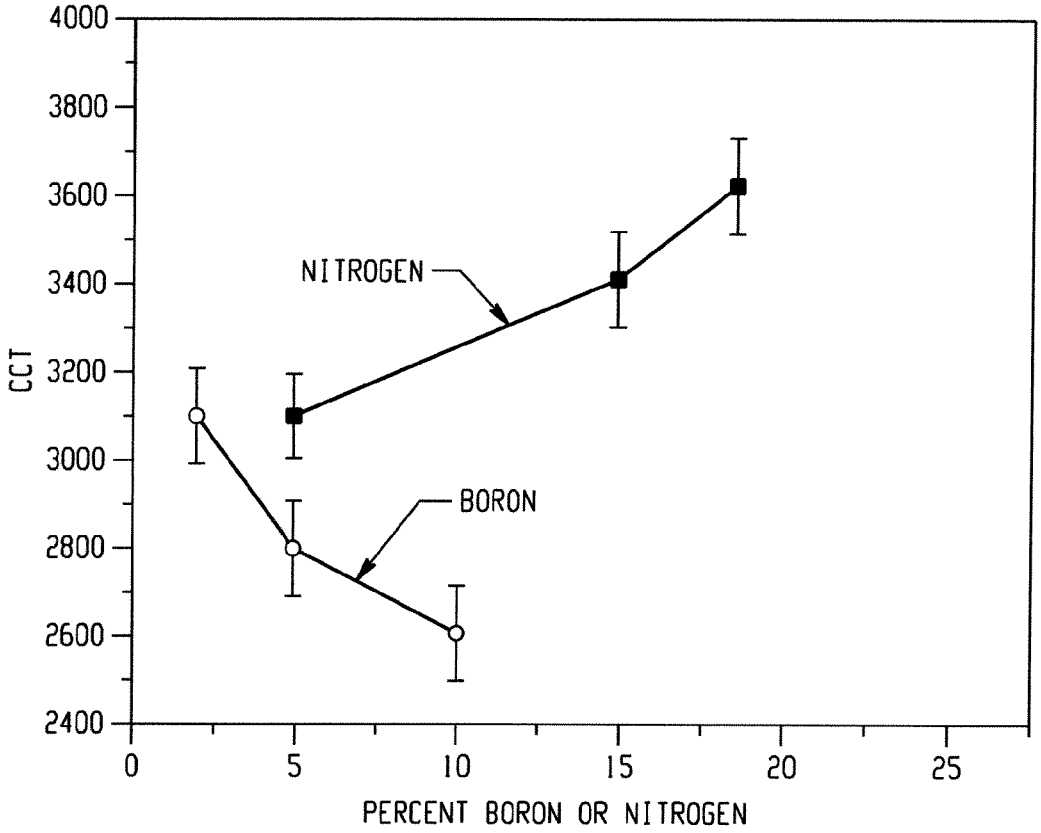
FIG. 7 is a plot of CCT vs. boron weight % and nitrogen weight % in a coating on a filament in accordance with one aspect of the exemplary embodiment.

Single coil tungsten filament lamps according to the exemplary embodiment were formed with a filament diameter of about 80 μm. The tungsten substrate was doped with tantalum and rhenium at the surface less than about 5 nm. The filament was coated with molybdenum diboride doped with about 5 wt % titanium, tantalum carbide, and tantalum carbonitride with thicknesses of 200 nm, less 400 nm and 500 nm respectively. The coating layer had a total thickness of less than about 1.2 μm. The surface was made denser, less than about 5 wt % porosity, with a pulse hydrogen burner for 30 minutes under an argon flow. As illustrated in FIG. 7, in one embodiment the coating layer may be configured for the color temperature of the lamp to increase with nitrogen and decrease with boron from a baseline correlated color temperature of about 3000K. For example, a nitrogen content of about 20 wt % but less than about 25 wt % may exhibit a CCT, e.g. of about 3400K, e.g., less than about 3600K respectively. For example, a boron content of about 3 wt % may exhibit a CCT, e.g. of about 3100K. A boron content of about 10 wt % may exhibit a lower CCT, e.g. of about 2600K. In a further embodiment, as described, the coating layer in part influences the emissivity of the surface positively in the visible spectrum range. For example, a nitrogen content greater than 20 wt % may block light in the infrared spectrum region, e.g., greater than 800 nanometers thereby increasing light in the visible regions, e.g., about 600 nanometers. In a further embodiment, the coating layer may include a boride content to reduce the possibility of carbon diffusion occurring. For example, boron may be at least 6 wt %, e.g., at least 7 wt %, and may be up to 9 wt %, e.g., up to 8 wt % of the coating layer.

The invention has been described with reference to the preferred embodiments. Obviously, modifications and alterations will occur to others upon reading and understanding the preceding detailed description. It is intended that the invention be construed as including all such modifications and alterations.

The invention claimed is:

1. A lamp comprising:

a filament for emitting light, the filament comprising:

an emissive substrate which emits radiation when an electric current is applied, the substrate comprising a first doped surface layer, and a second coating layer supported on the doped surface layer, the coating layer comprising a metal carbonitride and a boride.

2. The lamp of claim 1, wherein the emissive substrate is planar.

3. The lamp of claim 1, wherein the emissive substrate predominantly comprises tungsten.

4. The lamp of claim 1, wherein the doped surface comprises at least one metal selected from the group consisting of tantalum, rhenium, osmium, platinum, and combinations thereof.

5. The lamp of claim 1, wherein the doped surface comprises rhenium.

6. The lamp of claim 1, wherein the coating layer comprises at least one metal carbonitride selected from the group consisting of zirconium, niobium, hafnium, and tantalum carbonitrides.

7. The lamp of claim 1, wherein the coating layer comprises at least one metal boride selected from the group consisting of zirconium, niobium, hafnium, and tantalum borides.

8. The lamp of claim 1, wherein the coating layer predominantly comprises a mixture of tantalum niobium carbonitride and tantalum diboride.

9. The lamp of claim 1, wherein the coating layer comprises a first layer in which a wt % of carbon plus nitrogen exceeds a wt % boron and a second layer, spacing the first layer from the substrate, in which a wt % boron exceeds a wt. % of carbon plus nitrogen.

10. The lamp of claim 1, wherein the filament is in the form of at least one of a planar plate stack and a coil stack.

11. The lamp of claim 1, further comprising an envelope, the filament being disposed within the envelope.

12. The lamp of claim 11, further comprising conductors extending into the envelope which connect the filament with an associated source of power.

13. The lamp of claim 11, wherein the envelope has a three-dimensional shape made up of a plurality of geometric faces which define edges.

14. The lamp of claim 12, wherein the geometric faces have a polygonal shape selected from the group consisting of a triangle, tetragon, pentagon, hexagon, heptagon, octagon, nonagon, decagon, hendecagon, dodecagon, tridecagon, tetradecagon, and combinations thereof.

15. The lamp of claim 1, wherein the coating layer has a thickness of at least 100 nm.

16. A method of forming a filament comprising:

doping a surface of a tungsten substrate with a dopant;

annealing the doped substrate to form a diffusion layer; and depositing a coating layer on the doped surface, the coating layer being formed from a composite material which reduces diffusion of carbon into the substrate and which includes a metal, carbon, boron and nitrogen.

17. The method of claim 16, wherein the doping of the surface is performed by at least one of vapor deposition and ion implantation.

18. The method of claim 16, wherein the depositing of the coating layer on the substrate includes at least one of chemical vapor deposition, ion beam deposition and liquidthermal deposition.

19. The method of claim 16, further including annealing and compressing the coating layer and the doped substrate to form a planar plate or ribbon.

20. The method of claim 19, further including combining a plurality of the planar plates to form a plate stack filament or spirally winding the planar ribbon to form a ribbon coil stack filament.

21. A method of forming a lamp comprising:

forming a filament by the method of claim 16;

providing an envelope;

sealing the filament within the envelope, the filament comprising first and second layers, the first layer comprising a material which emits light when heated, a second layer comprising a composite material which includes a metal, boron, carbon and nitrogen; and associating an electrical conductor with the filament for connecting the filament with a power source.

22. A lamp comprising:

an envelope;

a filament sealed within the envelope and comprising first and second layers, the first layer comprising a material which emits light when heated, the second layer comprising a composite material which includes a metal, boron, carbon and nitrogen; and an electrical conductor connected with the filament for connecting the filament with a power source.

* * * * *